US010407861B2

(12) United States Patent
Sydlik

(10) Patent No.: US 10,407,861 B2
(45) **Date of Patent: *Sep. 10, 2019**

(54) SHEET PILE RETAINING WALL SYSTEM

(71) Applicant: Earth, Inc., Pittsburgh, PA (US)

(72) Inventor: Michael Sydlik, Pittsburgh, PA (US)

(73) Assignee: EARTH INC., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/145,383

(22) Filed: Sep. 28, 2018

(65) Prior Publication Data

US 2019/0127941 A1 May 2, 2019

Related U.S. Application Data

(63) Continuation-in-part of application No. 15/799,162, filed on Oct. 31, 2017, now Pat. No. 10,094,088.

(51) Int. Cl.

| | |
|---|---|
| ***E02D 5/02*** | (2006.01) |
| ***E02D 17/18*** | (2006.01) |
| ***E02D 5/08*** | (2006.01) |
| ***E02D 17/20*** | (2006.01) |
| ***E02D 29/02*** | (2006.01) |

(Continued)

(52) U.S. Cl.

CPC ..... *E02D 17/207* (2013.01); *E02D 5/04* (2013.01); *E02D 7/10* (2013.01); *E02D 29/0233* (2013.01); *E02D 2200/12* (2013.01); *E02D 2300/002* (2013.01); *E02D 2300/0032* (2013.01); *E02D 2600/20* (2013.01); *E02D 2600/30* (2013.01)

(58) Field of Classification Search

CPC .... E02D 5/02; E02D 5/04; E02D 5/08; E02D 17/207; E02D 7/02–165; E02D 29/02; E02D 29/0233

USPC ..... 405/274, 276–281

See application file for complete search history.

(56) References Cited

U.S. PATENT DOCUMENTS 1,277,847 A * 9/1918 Cahn ..... E02D 19/04 405/14

2,000,492 A * 5/1935 McKeen ..... E02D 29/02 405/262

(Continued)

FOREIGN PATENT DOCUMENTS

DE 4226067 A1 * 5/1993 ..... E01F 8/0023

*Primary Examiner* — Benjamin F Fiorello

*Assistant Examiner* — Stacy N Lawson

(74) *Attorney, Agent, or Firm* — Dunlap Bennett & Ludwig PLLC

(57) ABSTRACT

A sheet pile retaining wall system employing corrugated sheet piles not requiring temporary shoring to be used when widening and/or stabilization of existing highway embankment. The wall system provides a front face wall having a plurality of resistance fins perpendicularly extending therefrom via three-way connectors. The fin sheet piles first include a brace fin sheet for reducing stresses in the front face wall, then a series of additional resistance fin sheets terminating at an elevation below the face wall for accommodating a pipe drainage/utility cradle. Between the slope of the existing embankment, a temporary excavation bench, an excavation backslope, and the higher front face wall is reinforced concrete backfill for pre-stressing the wall system when fluid—and, when set, optionally engaging supplementary structural features within the set concrete backfill such as dowels/tie down anchors.

7 Claims, 3 Drawing Sheets

(51) Int. Cl.
*E02D 5/04* (2006.01)
*E02D 7/10* (2006.01)

(56) References Cited

U.S. PATENT DOCUMENTS

2010/0325819 A1* 12/2010 Abreu ..... E01D 19/02
14/73
2011/0064527 A1* 3/2011 Nottingham ..... E02D 5/02
405/274

* cited by examiner

SHEET PILE RETAINING WALL SYSTEM

CROSS-REFERENCE TO RELATED APPLICATION

This application is a continuation-in-part of and claims the benefit of priority of U.S. non-provisional application Ser. No. 15/799,162, filed 31 Oct. 2017, the contents of which are herein incorporated by reference.

BACKGROUND OF THE INVENTION

The present invention relates to earth retaining systems and, more particularly, to an alternate sheet pile retaining wall system with dowels/tie down anchors to provide for additional stability. This invention does not require temporary shoring to be used to provide for widening and/or stabilization of existing highway embankment.

As can be seen, there is a need for a sheet pile retaining wall system not requiring temporary shoring, yet adapted to accommodate embankment widening and/or stabilization along existing highway running adjacent to the work area. The sheet pile retaining wall system embodied herein provides an outer row of corrugated, (Z-shaped) sheet piles that constitutes the face wall portion of the structure with perpendicular, corrugated (Z-shaped) sheets comprising resistance fins connected to the outer sheets via three-way connectors along the length of the wall; this alternate sheet pile wall system is also equipped with dowels/tie down anchors to provide for additional stability. This sheet pile retaining wall system for all practical purposes would be built without the need for massive quantities of excavation, select rock/aggregate backfill, and temporary shoring.

SUMMARY OF THE INVENTION

In one aspect of the present invention, the highway embankment widening/and or stabilizing retaining wall system provides a face wall defining a front face of the wall system having an existing embankment gradient; the face wall including a plurality of face wall sheet piles, wherein each face wall sheet pile has a face length, the face length including a depth extending below the gradient; and a face cantilever extending above the gradient; a group of fin sheets perpendicularly extending from the face wall; the group of fin sheets including a plurality of fin sheet piles having a fin bottom for the fin sheet directly connecting to the adjacent face wall sheet reasonably close to the elevation of the adjacent face wall bottom, and wherein said face and fin sheet piles are corrugated (Z-shaped); a reinforced concrete backfill disposed in a backfill space defined by the gradient, a temporary excavation bench, an excavation backslope, the face wall sheets, and adjacent fin sheets; an optional drainage/utility cradle disposed in a depressed cradle space paralleling the face wall defined by the adjacent, face wall sheets, the concrete backfill, and excavation backslope; and a three-way connector interconnecting adjacent face wall sheet piles and first fin sheet piles.

In another aspect of the present invention, the reinforced concrete backfill in its initial fluid state will serve to prestress the wall system including face and fins, and in its set state help reduce overall pressure acting on the face wall along with providing composite steel/concrete backfill structural interaction not possible with earthen backfill or more weakly cemented backfill only.

In yet another aspect of the present invention, the sheet pile embankment retaining and/or stabilizing system includes the following: a face wall defining a front face of the embankment having an existing gradient; the face wall including a plurality of face wall sheet piles, wherein each face wall sheet pile terminates at a cantilever elevation located above the gradient; at least one brace fin sheet pile, each brace fin sheet pile spaced apart, along and perpendicularly connected to the face wall, each brace fin sheet pile terminating at a brace elevation located between the cantilever elevation of the face wall and the gradient; a plurality of additional resistance fin sheet piles connected linearly to each brace fin sheet pile, each plurality of resistance fin sheet piles terminating at a cradle elevation located below the cantilever elevation, wherein each plurality of interconnected resistance fin sheet piles interconnects each respective brace fin sheet pile so that said respective fin sheet piles define a linear relationship relative to each other; a temporary excavation bench defined by an absence of removed embankment between adjacent plurality of fin sheet piles between eighteen and twenty-four inches below the cradle elevation; a step notch formed in the gradient; an excavation backslope; a reinforced concrete backfill disposed in each backfill space defined by the gradient, the temporary excavation bench, the excavation backslope, the face wall, the step notch, and adjacent pluralities of fin sheet piles; a plurality of dowels/tie down anchors operatively associated with the reinforced concrete; a drainage/utility cradle seated on the reinforced concrete backfill; a three-way connector interconnecting each adjacent face wall sheet piles and each brace fin sheet pile; and wherein all sheet piles are generally corrugated.

These and other features including dowels/tie down anchors to provide for additional stability along with other, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an alternate sheet pile retaining wall system with dowels/tie down anchors to provide for additional stability comprised of corrugated (Z-shaped) sheets for widening and/or stabilization of existing highway/embankment under adjacent, active traffic conditions—not requiring temporary shoring. The wall system may provide a front face wall having a plurality of interconnected fin sheets perpendicularly extending therefrom. Between the gradient of the existing embankment, a temporary excavation bench and the higher front face wall is reinforced concrete backfill for pre-stressing the wall system when fluid—and, when set, being impervious and acting compositely with the engaged corrugated sheets while supporting the aforementioned cradle, from which the remaining construction can build off of while reducing overall earth pressure acting on the face wall upon completion of construction. In its set state, the backfill will result in a reduction of overall pressure acting on the face wall along with stress reduction in the face wall via composite steel/concrete backfill structural interaction not possible with earthen backfill only, the effect of which may be enhanced by optionally engaging supplementary structural features within the set concrete backfill such as dowels/tie down anchors to help hold back the face wall and resist sliding and overturning forces acting on the wall system and/or serve as supplementary deep foundation elements of the wall system. And atop this concrete backfill would be an optional, drainage cradle of sufficient width to accommodate highway drainage/utility construction.

Figure 2:
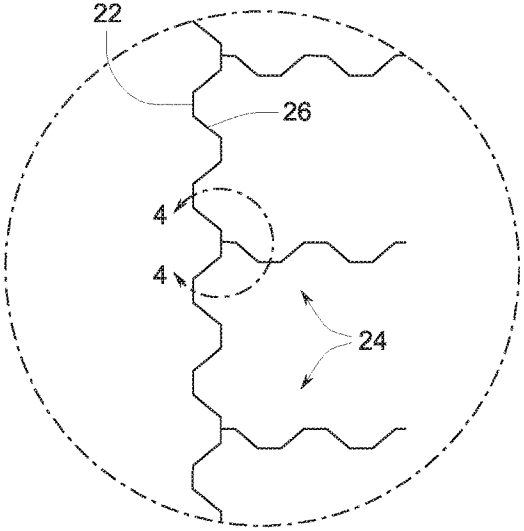
FIG. 2 is a schematic plan view of an exemplary embodiment of the present invention, taken along plane 2-2 of FIG. 1.
Figure 1:
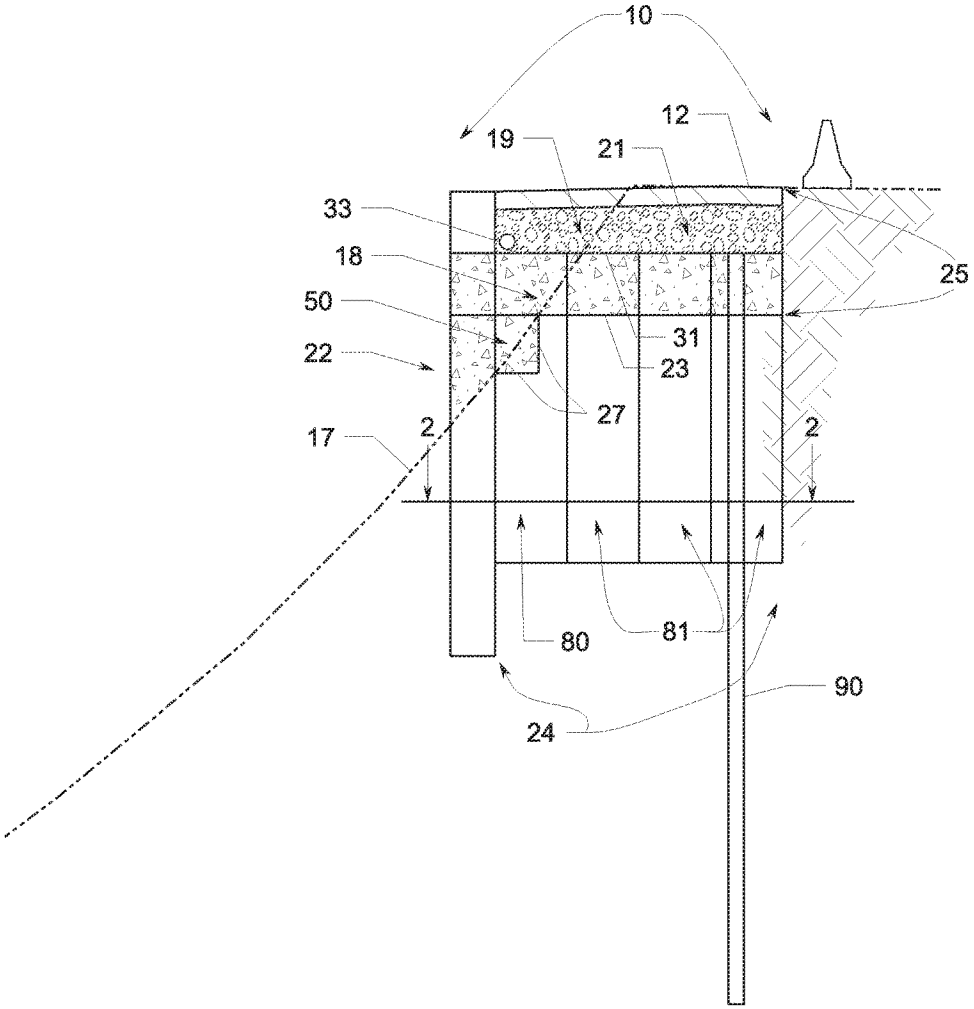
FIG. 1 is an elevation view of an exemplary embodiment of the present invention.
Figure 3:
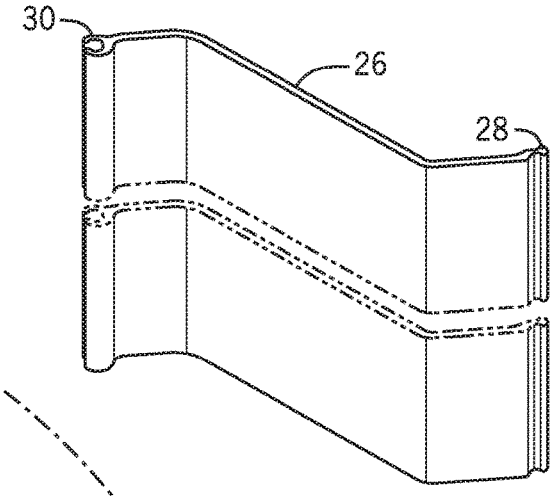
FIG. 3 is a perspective view of an exemplary embodiment of an individual Z-shaped sheet pile of the present invention.
Figure 4:
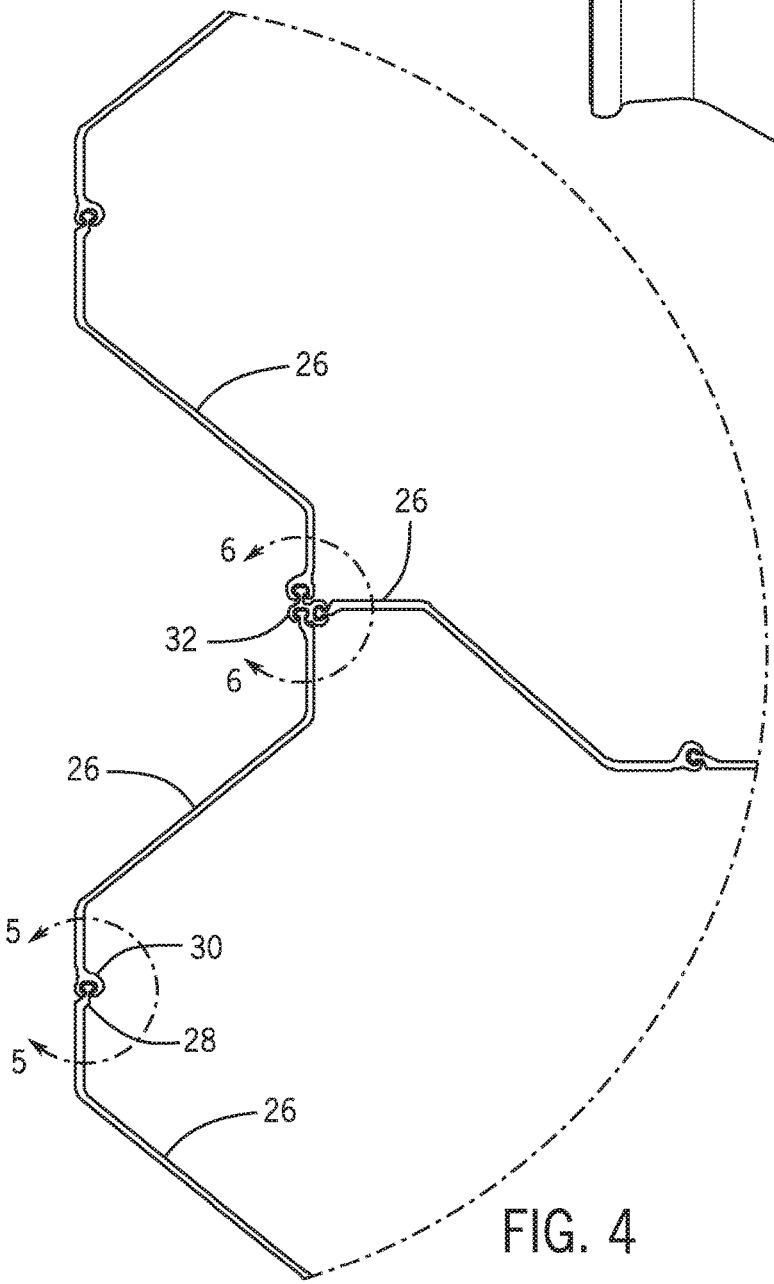
FIG. 4 is an enlarged detail plan view of an exemplary embodiment of the present invention, taken along line 4-4 of FIG. 2.
Figure 5:
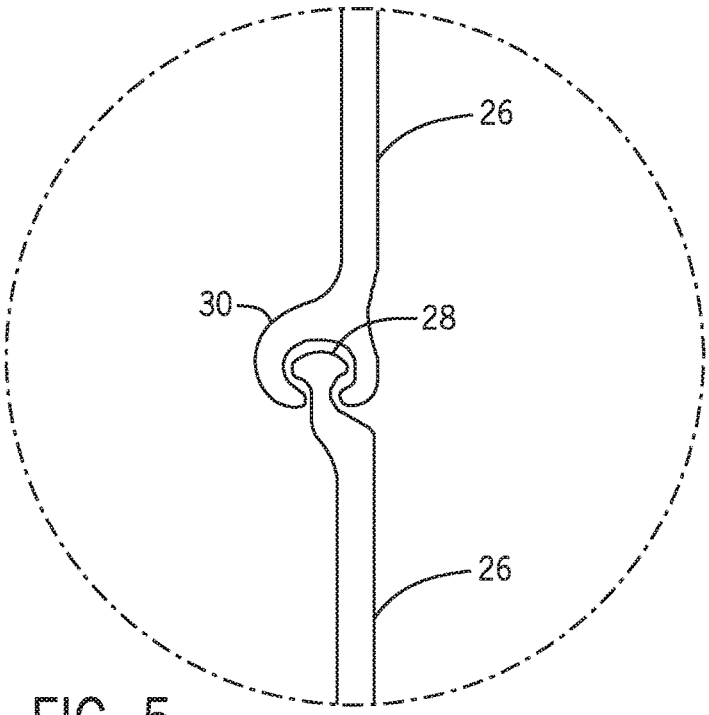
FIG. 5 is an enlarged detail plan view of an exemplary embodiment of the present invention, taken along line 5-5 of FIG. 4.

Referring to FIGS. 1 through 6, the present invention may include an alternate sheet pile retaining wall system 10 not requiring temporary shoring for its construction. The sheet pile retaining wall system 10 will include a fin sheet pile assembly 24 driven into an embankment having a gradient 17 for widening and/or stabilizing existing highway/embankment, bounded on the back by an excavation backslope 25. The wall system 10 provides a front face wall 22 including a plurality of interconnected Z-shaped sheet piles forming an exterior element facing an exterior environment of a linear nature (deriving the majority of its strength through bending resistance) which is preferable for highway retaining wall construction given typical right-of-way limitations and aesthetic considerations rather than similarly-concepted flat sheet piles requiring an outwardly-bowed face wall (deriving the majority of its strength solely through tension) more common in marine bulkhead construction where aesthetics are typically of much lesser concern. For increased aesthetics, vertically-aligned, non-structural, precast concrete or lighter weight, petroleum-based, plastic veneers of enhanced durability may be readily attached as panels to the structural steel face wall, with one wall panel generally required for every two face wall sheets. The system also includes a fin sheet pile assembly 24 comprised of Z-shaped sheet piles perpendicularly connected to and extending from the face 22 away from the exterior environment, as illustrated in FIGS. 1 and 2. The fin sheet pile assembly 24 includes a plurality of brace fin sheet piles 80 individually spaced apart along and connected to the face wall 22, substantially bracing the face wall 22 cantilevering above the fin sheet pile assembly 24. Connected to each brace fin sheet pile 80 is the remainder of fin sheet piles 81 which provide lateral resistance to earth pressure forces acting on the face wall 22, which in turn provide for an adjacent, depressed drainage/utility cradle 19. Those fin sheets located farther away from the face wall 22 provide more resistance to earth pressure acting on the wall than those closer given their distance from the face wall 22 based on earth pressure theory.

It should be understood by those skilled in the art that the use of directional terms such as above, below, and the like are used in relation to the illustrative embodiments as they are depicted in FIG. 1, the above direction being further toward the top of the corresponding figures and a downward direction being further toward the bottom of the corresponding FIG. 1.

The concrete backfill 18 may be used/considered as a pre-stressing measure described more in depth below. In certain embodiments, the concrete backfill 18 may be operatively engaged to the face wall 22 and fin sheets 24, e.g., via shear studs or mid-span 'mini-fins' of lesser number than the aforementioned 'main fins') to help hold back the face wall 22 upon set. And following set, the reinforced concrete backfill mass may also serve as a medium through which drilling through it and beyond would occur to allow for the installation of dowels/tie down anchors which may be vertical or inclined away from the face wall with increasing depth founded within soil and/or rock materials outside/below the limits of sheeting to assist in resisting sliding and overturning forces acting on the wall system and/or serve as supplementary deep foundation enhancements to the wall system.

Moreover, the concrete backfill 18 enables the seating of a drainage cradle 19 on the set cementitious backfill 18 at cradle elevation 31.

Moreover, the concrete backfill 18 enables the seating or cradle elevation 31 of a drainage cradle 19 on the set cementitious backfill 18. Once the cementitious backfill 18 hardens, it no longer pushes directly against the face wall 22, but sits down vertically on its notched bottom within the embankment. From there, the hardened concrete backfill 18 may provide an impervious platform/pathway for the drainage cradle 19, which would be designed to accommodate pipes/utilities 33 behind the front face wall 22.

Figure 6:
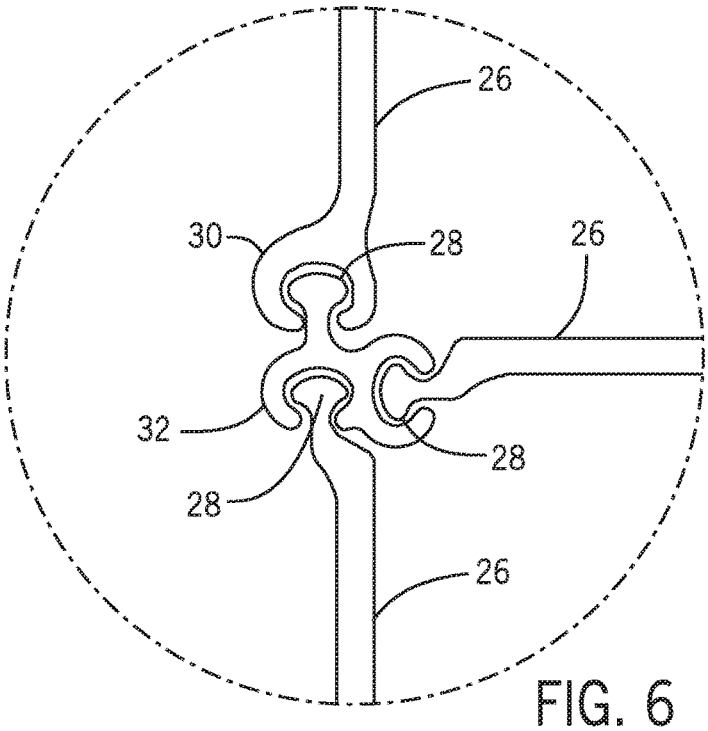
FIG. 6 is an enlarged detail plan view of an exemplary embodiment of the present invention, taken along line 6-6 of FIG. 4.

Referring to FIGS. 3 through 6, each sheet pile 26 would be corrugated (Z-shaped) for the reasons stated above as it extends from a male interlocking end 28 to a female interlocking end 30 for enabling adjacent sheet piles 26 to be interlocked. In other words, a perpendicular, vertically planar soil anchor is provided by mating the male interlocking end 28 at one end of a first sheet 26 to a second female interlocking end 30 at the end of a second sheet 26. The interlocking of fin sheet piles and face wall sheet piles happens at the interface of two adjacent face wall sheets via a three-way connector 32, as illustrated in FIG. 6. The three-way connector 32 provides a profile and/or arrangement of male interlocking ends 28 and female interlocking ends 30 as illustrated in FIG. 6.

Geotechnical Considerations

The perpendicular sheets will serve as vertically planar, continuous tiebacks, i.e., fins providing resistance to lateral loading acting on the wall through the following mechanisms: a) soil/steel interaction, i.e., shear resistance including friction and cohesion and b) the dead weight of the fins including soil adhering to them extending some distance beyond the physical limits of the steel comprising the sheets, enhanced by vibratory densification during pile driving to provide yet additional restoring moment to the overall wall system. It being understood that the design of the alternate sheet pile wall system 10 as well as the designs of other wall types—particularly those founded within slopes—will need to consider global stability as part of the overall design process—as well as other design criteria peculiar to each wall type. It being understood that the embankment being retained has an upper surface, i.e., the inclined part of the embankment, or gradient 17.

In one embodiment, the alternate sheet pile wall system 10 incorporates reinforced concrete backfill 18 in a wedge defined by the existing embankment gradient 17, the face wall 22, and temporary excavation bench 23, an excavation backslope 25, said backfill portion being bounded along its upper periphery by the drainage/utility cradle 19. The hydrostatic fluid pressure of the concrete backfill 18 will act to pre-stress the wall system 10 prior to set before placement of the overlying backfill and pavement structure. And by incorporating step notching 27, as illustrated in FIG. 1, into the existing embankment gradient, wedge-type, block loading acting on the face wall 22 will be eliminated upon set of the concrete backfill material 18 within the backfill space 50 defined by the face wall 22 and the step notching 27 into the gradient 17.

Structural Considerations

From a structural standpoint, the most critical point along the face wall is where it is cantilevered above the brace fin sheet pile 80 directly connecting to the face wall 22 with moment within the wall sheet being the controlling factor in its design. See FIG. 1. By limiting the cantilever height, the maximum moment (and required section modulus, which is a function of the square of the unsupported height) will be limited. This feature along with the pressure-reducing and bending moment-reduction effect provided by the composite, corrugated nature of the steel sheet piles interacting with the concrete backfill 18 (whether reinforced or not and whether serving as a medium through which dowels/anchors 90 may be optionally installed and engaged) is key to the design concept—and why it can be so competitive in cost when compared to other wall types in that relatively lighter, i.e., less expensive, face wall sheet sizes (weights) may be employed.

The fin sheets 24 will act in tension—serving as vertically-planar, continuous anchors—providing increased resistance to lateral movement of the face wall 22 as a direct result of the corrugations in the development of shearing resistance including both frictional and cohesive components along with restoring moment including the dead weight of the steel fin sheets and adhered cementitious backfill and adhered earthen material (enhanced in part as a result of densification of existing earthen embankment material as a result of the vibratory process associated with the driving of sheet piles). With the strength of steel being measured in tens of thousands of pounds per square inch, the interconnected, continuous nature of sheet piles results in loadings in tension being relatively low when compared to the available strength—and it is for this reason that fin sheet sizes (weights) may be considerably less than sheet sizes required for the face wall.

In addition to eliminating the need for temporary shoring to allow for the construction of this particular, alternate sheet pile retaining wall system 10, the other big key to its economic success is the methodology for how it is constructed.

Construction Methodology

Basically, a temporary bench 23 would be excavated along an excavation backslope 25 to a depth of 18 inches to 2 feet below the proposed tops of the innermost fin sheets 24, i.e., those sheets situated higher on the embankment closer to the existing highway. (The 18 inch to 2 foot clearance would allow for the pile hammer to grab/secure these piles for subsequent driving and installation of dowels/tie down anchors 90 and subsequent placement of reinforced concrete backfill 18 to the top of the fin sheet assembly 24.)

Backfilling with earthen (non-cementitious) material 21 beneath the roadway in the wall construction zone would occur. In conjunction with this construction would be the installation of optional roadway drainage (and utilities) within the specified drainage/utility cradle 19. At this point, construction of the overlying pavement structure 12 and moment slab/safety barrier (or guide rail)—not shown on FIG. 1—would then occur.

Now with particular regard to the development of tension in the wall fins, a slight, inward transverse force could be applied to the fin sheet assembly 24 during vibrating/driving, thus removing play in the interlocks. As necessary to keep the face wall within horizontal tolerance, wall sheets at the 3-way connectors 32 would be re-visited and a slight, outward transverse force could be applied to the pile hammer. Vertical tolerance would be achieved by driving pile lengths longer than design lengths and cutting/burning off the excess, as may be required.

It should be understood, of course, that the foregoing relates to exemplary embodiments of the invention and that modifications may be made without departing from the spirit and scope of the invention as set forth in the following claim.

What is claimed is:

1. A sheet pile embankment retaining and/or stabilizing system, comprising:

a face wall defining a front face of the embankment having an existing gradient;

the face wall including a plurality of face wall sheet piles, wherein each face wall sheet pile terminates at a cantilever elevation located above the gradient;

two or more spaced apart brace fin sheet piles, each brace fin sheet pile perpendicularly connected to the face wall, each brace fin sheet pile terminating at a brace elevation located between the cantilever elevation of the face wall and the gradient;

a plurality of resistance fin sheet piles connected to each brace fin sheet pile so as to define a linear relationship relative to each other, each plurality of resistance fin sheet piles terminating at a cradle elevation located below the cantilever elevation;

an excavation bench defined in part by a removed portion of the embankment between adjacent pluralities of the resistance fin sheet piles to at least eighteen inches below the cradle elevation but for less than half a vertical length of each resistance fin sheet pile and for a portion of a horizontal length of said adjacent pluralities of the resistance fin sheet piles;

a reinforced concrete backfill disposed in a backfill space defined by the gradient, the excavation bench, the face wall, and adjacent pluralities of the resistance fin sheet piles; and a plurality of dowels/tie down anchors operatively associated with the reinforced concrete.

2. The sheet pile embankment retaining and/or stabilizing system of claim 1, further comprising:

a drainage/utility cradle seated on the reinforced concrete backfill.

3. The sheet pile embankment retaining and/or stabilizing system of claim 1, further comprising:

a three-way connector interconnecting each adjacent face wall sheet piles and each brace fin sheet pile.

4. The sheet pile embankment retaining and/or stabilizing system of claim 1, wherein all sheet piles are generally corrugated.

5. The sheet pile embankment retaining and/or stabilizing system of claim 1, further comprising an excavation backslope that further defines each backfill space.

6. The sheet pile embankment retaining and/or stabilizing system of claim 1, further comprising a step notch formed in the gradient so as to further define said backfill space.

7. A sheet pile embankment retaining and/or stabilizing system, comprising:

a face wall defining a front face of the embankment having an existing gradient;

the face wall including a plurality of face wall sheet piles, wherein each face wall sheet pile terminates at a cantilever elevation located above the gradient;

two or more spaced apart brace fin sheet piles, each brace fin sheet pile perpendicularly connected to the face wall, each brace fin sheet pile terminating at a brace elevation located between the cantilever elevation of the face wall and the gradient;

a plurality of resistance fin sheet piles connected to each brace fin sheet pile so as to define a linear relationship relative to each other, each plurality of resistance fin sheet piles terminating at a cradle elevation located below the cantilever elevation;

an excavation bench defined in part by a removed portion of the embankment between adjacent pluralities of the resistance fin sheet piles and between eighteen and twenty-four inches below the cradle elevation for a horizontal length of said adjacent pluralities of the resistance fin sheet piles;

a step notch formed in the gradient;

a reinforced concrete backfill disposed in a backfill space defined by the gradient, the excavation bench, an excavation backslope, the face wall, the step notch, and adjacent pluralities of the resistance fin sheet piles;

a plurality of dowels/tie down anchors operatively associated with the reinforced concrete;

a drainage/utility cradle seated on the reinforced concrete backfill;

a three-way connector interconnecting each adjacent face wall sheet piles and each brace fin sheet pile; and wherein all sheet piles are generally corrugated.

* * * * *